United States Patent [19]

Brovman et al.

[11] 4,108,237

[45] Aug. 22, 1978

[54] MACHINE FOR SEMICONTINUOUS CASTING OF METALS

[76] Inventors: Mikhail Yakovlevich Brovman, ulitsa N.Kurchenko, 12, kv. 22; Ivan Konstantinovich Marchenko, ulitsa Lenina, 6, kv. 94; Nikolai Mikhailovich Kozy, ulitsa Parkovaya, 45, kv. 78; Ilya Lukyanovich Veligura, ulitsa B.Khmelnitskogo, 15, kv. 21; Ivan Fedorovich Bairakov, ulitsa Shmidta, 28, kv. 1, all of Kramatorsk; Evgeny Tikhonovich Dolbenko, ulitsa Garibaldi, 10, kv. 93, Moscow; Jury Evgenievich Kan, Ananievsky pereulok, 7/14, kv. 49, Moscow; Abram Vladimirovich Leites, Simferopolsky bulvar, 29, kv. 2-131, Moscow, all of U.S.S.R.

[21] Appl. No.: 779,083

[22] Filed: Mar. 18, 1977

[51] Int. Cl.[2] ..... B22D 11/08

[52] U.S. Cl. ..... 164/425; 164/445

[58] Field of Search ..... 164/273 R, 274, 281, 164/82, 269, 425, 445, 426, 456; 310/44, 77, 92, 93

[56] References Cited

U.S. PATENT DOCUMENTS

| | | | |
|---|---|---|---|
| 2,806,263 | 9/1957 | Hogan | 164/269 X |
| 3,143,776 | 8/1964 | Ball | 164/269 X |

*Primary Examiner*—Francis S. Husar
*Assistant Examiner*—John S. Brown
*Attorney, Agent, or Firm*—Lackenbach, Lilling & Siegel

[57] ABSTRACT

The machine for semicontinuous casting of metals comprises a rack-and-gear drive for withdrawal an ingot and for moving a carriage fitted with a dummy bar along a vertical column. The racks of said drive are fixed on said carriage and the gear wheels with a pitch approximating the length of said racks are disposed along said column. The initial weight of said carriage fitted with the dummy bar exceeds slightly the initial force required for withdrawal of the ingot from the mold. To maintain constant operating conditions for the driving electric motor of the ingot withdrawal gear, provision is made for a ferromagnetic powder brake whose exciting winding is coupled with an ingot length sensor and whose control winding is coupled with an ingot withdrawal force sensor.

5 Claims, 5 Drawing Figures

FIG. 3
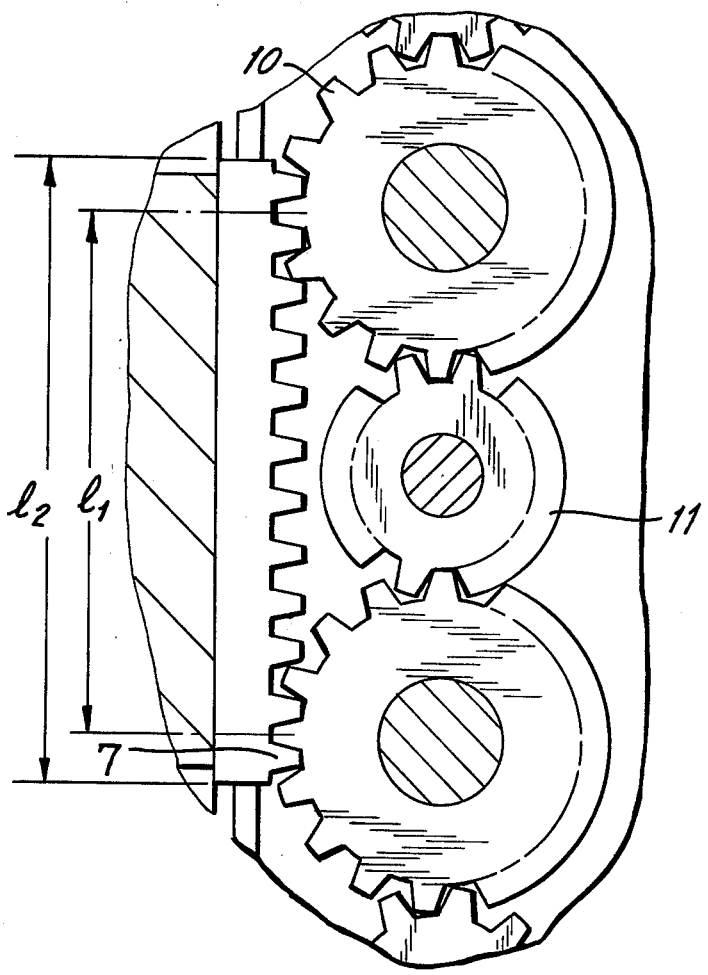
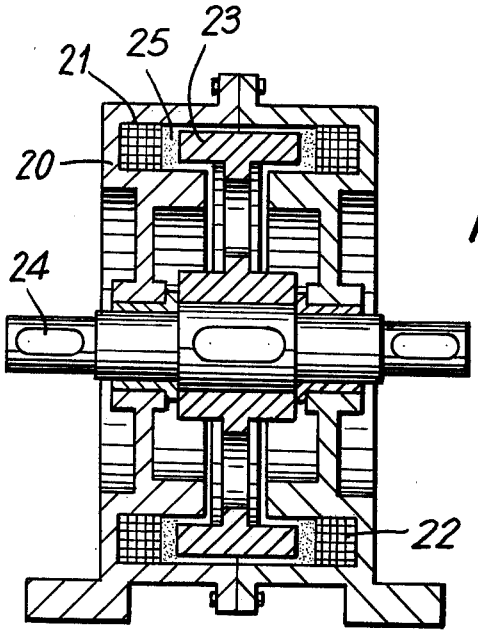
FIG. 4

MACHINE FOR SEMICONTINUOUS CASTING OF METALS

The present invention relates to ferrous and nonferrous metallurgy and can be of particular advantage in casting heavy forging and rolling ingots and consumable electrodes for electroslag and vacuum-arc refining. An ever greater amount of such large-section ingots is required by both iron and steel engineering and machine-building.

Large-size ingots are in great demand from both break-down mills (roughers) and forge shops. However, when produced by teeming into molds the ingots adaptable for rolling on said roughersblooming and slabbing mills must be slitted upon rolling to remove 11–16% of the metal in the shrinkhole zone (depending on the ingot length, its shape and on the type of article to be produced therefrom). Meanwhile the electroslag and vacuum-arc refining techniques require heavy ingots varying in diameters from 400 to 1300 mm. These new processes and plants for effecting same, developed during the last decade, open up great possibilities for improving the quality of metal, and the problem of providing said plants with electrodes has vital importance. A number of plants for casting electrodes were built in the sixties. Their operation has pointed to the fact that use of the thus obtained electrodes provided not only a higher quality of metal but offered an 8% gain in the yield. Consumable electrodes measuring 370×370 mm in cross-section are employed for producing 4-ton ingots, while round electrodes, 405 mm in diameter, are adaptable for casting into 5-ton ingots. However, in practice a need arises for even heavier electrodes, about 1300 mm and upwards in diameter, said electrodes now being cast in long built-up molds. Atomizing of a metal stream that is being fed from a height of 8–10 m causes heavy spattering which results in a poor surface finish of the castings and in heavy metal losses. Obviously said process needs further improvement. Uphill teeming techniques used for casting said electrodes is hardly expedient, insofar as it will lead to supercooling of the metal on its meniscus with the ensuing defects. As to the currently employed production process for casting ingots designed for forging, it is far from being perfect.

At present forging ingots, produced at machine-building plants, are usually cast in molds, the yield ranging in that case only within 60–65%. Thus, in heavy machine-building it is 63%,20% of the ingot mass being rejected when fettling a shrinkhead, 5% is cut off from the ingot bottom end, 6% accounts for scale losses and 6% for crops. During machining almost 50% of metal losses are associated with surface defects of said ingots and dimensional inaccuracy of forgings accounts for 13%. Hence the present-art ingot producing technique causes metal losses amounting to more than 50% of the metal. Obviously, production processes wherein metal rejects exceed 37% must be regarded as extremely inadequate.

Continuous casting machines succeed in producing ingots for section mills but only up to 300–400 mm in cross-section. Therefore some experiments were tried with semicontinuous machines which would have been adaptable for casting large-size ingots of round and square cross-section into cooled molds.

But for lack of reliable construction of said semicontinuous casters which would be able to provide both smooth ingot transfer and a constant transfer speed, these attempts encountered great difficulties.

Speed variations, high acceleration and jerking in the course of transfer of a large-size ingot deteriorate sharply its quality and lead to heterogeneous properties, cracks and other defects. In transferring said ingot, its steady movement with a constant speed has a great influence on both the dimensions of a shrinkage pipe and crops.

It should be noted that said constant transfer speed must be provided for steel ingots of large cross-section whose mass tends to rise from 5–10 t to 50–100 t and over during their withdrawal period. In this case the motor is switched over from driving duty to operation in the capacity of a generator with the ensuing great variations in speed which adversely affect surface finish of the ingot.

Also known in the art is a machine for semicontinuous casting of metals (see, e.g., GFR Patent No. 909142, Cl.B$^2$ 11/14 filed on Mar. 11, 1954) comprising a mold, a carriage with a dummy bar fixed thereon, an inlet table and an ingot withdrawal gear fitted with a drive for rotating rotation gear wheels rolling along toothed racks attached to columns.

The main disadvantages of the above machine are as follows:

the layout of an ingot withdrawal gear drive wherein it is arranged on the movable part of said gear, a feature which renders said drive complicated and cumbersome and increases machine height when casting heavy ingots;

the layout of the ingot withdrawal gear drive wherein the toothed racks and gear wheels are located in the zone of high temperatures, water and steam which diminishes the functional reliability of the machine, and a substantial rise in loads acting upon said ingot withdrawal gear drive as an ingot of large cross-section is being withdrawn from a mold, which causes the operating conditions of said drive to deteriorate. The mold moving to-and-fro with an advance creates alternating loads applied to the ingot withdrawal gear drive which brings about dynamic loads and decreases the service life of the drive elements.

The main object of the present invention is to provide a machine for semicontinuous casting of metals which would be adaptable for casting heavy ingots of up to 1000 mm cross-section, would be comparatively compact and require a minimun floor area.

Another object of the invention is the provision of a machine for semicontinuous casting of metals which ensures a reliable, highly efficient casting process with an ingot being transferred steplessly and at a stable speed maintained during its withdrawal from a mold.

Still another object of the invention is the provision of a machine for semicontinuous casting of metals featuring an increased service life and being more convenient to service.

Yet another object of the invention is to provide a machine for semicontinuous casting of metals adaptable for producing large-size ingots with a mass of up to 50–100 t and over and ensuring higher quality and more homogeneous ingots thus obtained along with a better surface finish.

A further object of the invention is the provision of a machine which would ensure a more efficient metal casting process, by reducing to a minimum the size of a shrinkhole and ingot crops without complicating substantially its construction.

These and other objects of the present invention are achieved by providing a machine for semicontinuous casting of metals, comprising a frame-mounted mold, a guide vertical column that is arranged parallel to the ingot withdrawal axis near the mold, a movable carriage with a cantilever carrying a dummy bar, said carriage being mounted on said vertical column, and a transfer gear for moving said carriage with the dummy bar for withdrawing an ingot from a mold, said transfer gear comprising a driving electric motor, a reduction gear and a rack-and-gear drive. Said machine is characterized in that the toothed rack of said drive is fixed directly on the movable carriage, the gear wheels interacting with said rack being located along the length of said guide column so that the driving members of said ingot withdrawal gear, i.e. an electric motor and the reduction gear, are mounted stationary at a sufficient distance from the zone of elevated temperatures, said driving members of the ingot withdrawal gear comprising braking means adapted to control mechanical forces growing progressively during the ingot withdrawal period to maintain a constant load on said driving motor.

This design concept not only decreases the overall dimensions of the proposed machine as a whole and enhances its functional reliability, due to the driving motor and reduction gear being installed stationary and at a sufficient distance from the high-temperature zone, but also ensures a smooth and uniform withdrawal of the ingot, keeping thereby the ingot withdrawal gear motor from acting as a generator as the ingot mass is growing during the casting process.

According to one of the alternate embodiments of the present invention, a machine for semicontinuous casting of metals is characterized in that gear wheels of said rack-and-gear drive are located in succession one above another. In addition, idlers are positioned between adjacent gear wheels so that the distance between the centers of the adjacent gear wheels varies within 0.5–1.0 of the length of said toothed rack fixed on the carriage.

Said technical improvement represents one of the optimized layouts which provides for a minimum rack length and hence carriage height along with a maximum distance between the gear wheels of said rack-and-gear-drive.

In compliance with another possible embodiment of the invention, a machine for semicontinuous casting of metals is characterized in that when in its initial top position, the weight of the movable carriage varies from 1.05 to 1.50 of the mechanical force required for withdrawal of an ingot out of the mold.

Said engineering solution is capable of providing at the very first moment of the casting procedure an adequate mechanical force that is sufficient for withdrawal of an ingot out of a mold without resorting to additional gear loads.

In accordance with another embodiment of the invention, the machine for semicontinuous casting of metals is characterized in that installed intermediate of a mold and a frame is an ingot withdrawal force sensor. The reduction gear is associated with another sensor adapted for measuring the length of the ingot being withdrawn. The sensors are operatively coupled to said braking means for controlling the brake force as the ingot is being withdrawn out of the mold.

This engineering solution is aimed at providing a constant monitoring of the casting procedure so that as an ingot is being withdrawn out of the mold the brake force would increase accordingly to maintain an essentially constant loan on the driving electric motor.

Finally, in compliance with another embodiment of the present invention, a machine for semicontinuous casting of metals if characterized in that said braking means comprises a ferromagnetic powder brake made in the form of a double-shaft electric motor whose exciting winding is coupled with said ingot length sensor and whose control winding is coupled with said ingot withdrawal force sensor.

This engineering improvement makes it possible to employ most advantageously the basic principle of said ferromagnetic powder braking devices whereby their braking torque is independent of the rotative speed of the shaft of said braking device. In such brakes the developed brake force is determined largely by the current magnitude in the exciting and control windings.

The nature of the invention will be clear from the following detailed description of a particular embodiment to be had in conjunction with the accompanying drawings, in which FIG. 1 is a longitudinal cross sectional view of a machine for semicontinuous casting of metals, according to the present invention;

FIG. 3 is an enlarged view showing the meshing of the teeth of the rack and the teeth of the gear wheels;

FIG. 4 is a longitudinal cross sectional view of the ferromagnetic power brake.

Figure 1:
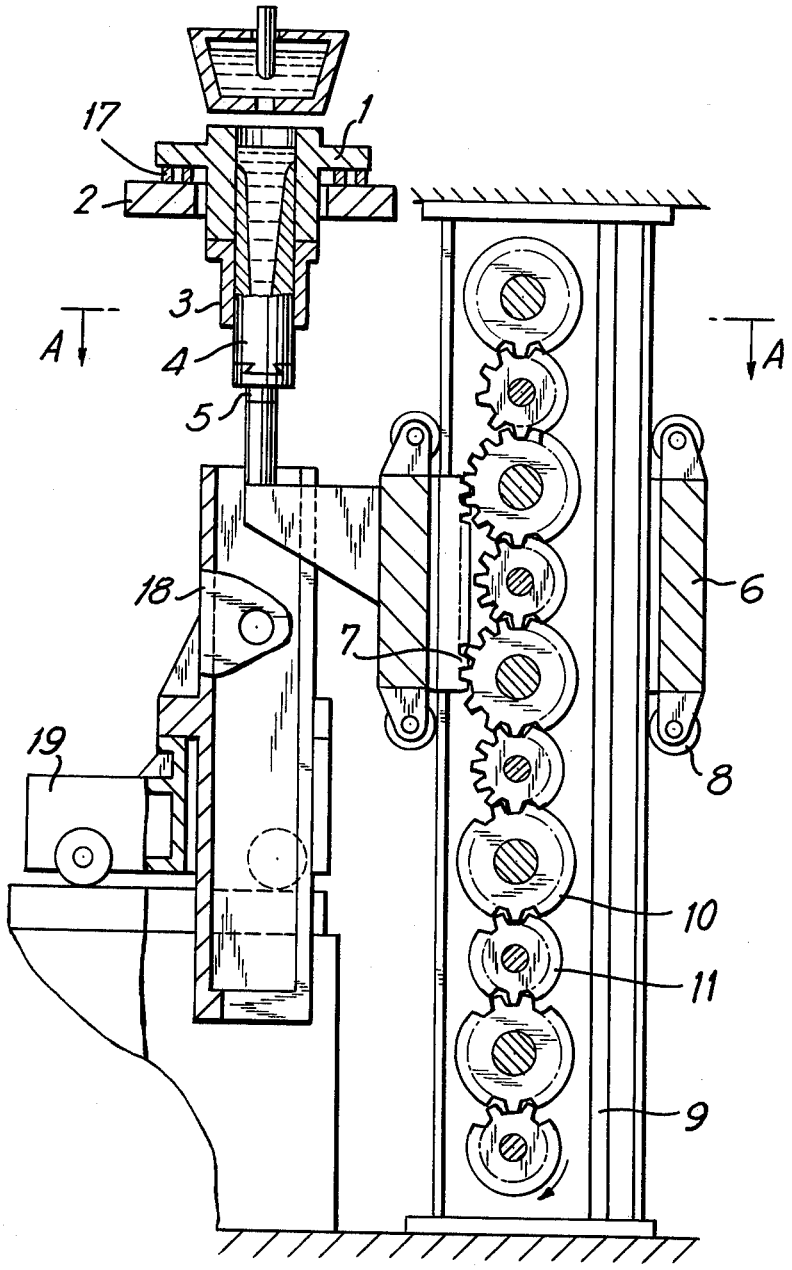
Figure 2:
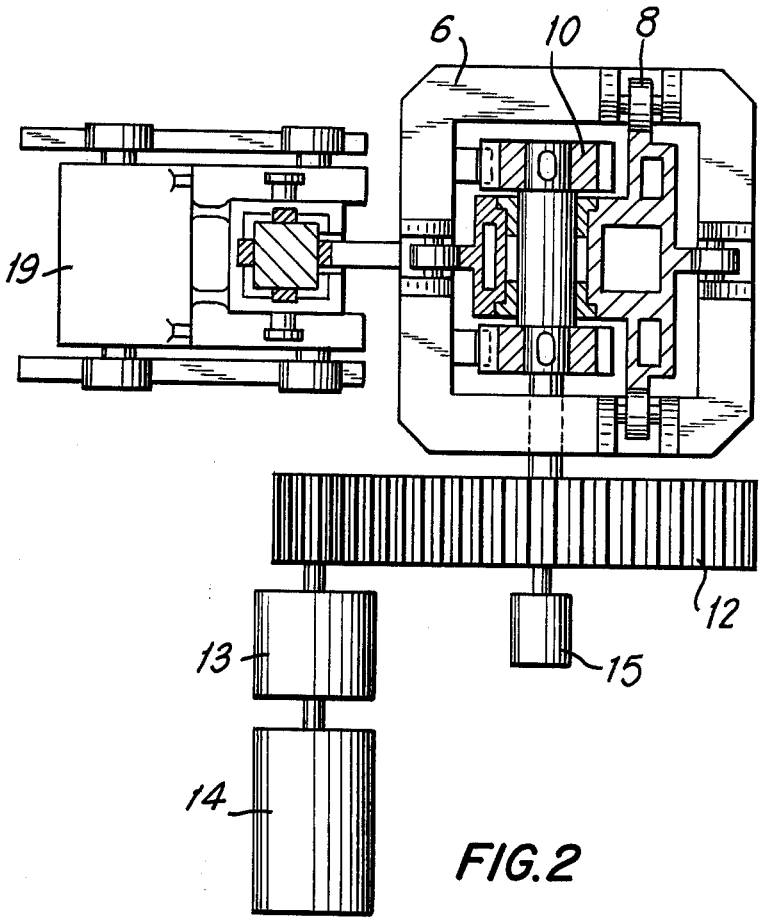
FIG. 2 is a top plan view of the machine.

The machine for semicontinuous casting of metals comprises a mold 1 (FIGS. 1 and 2) mounted on a frame 2, which has a swinging motion. Suspended from the mold 1 is a beam apron section 3, said section being secondary cooled. An ingot 4 interconnected with a dummy bar 5 is drawn by means of a raising-and-descending movable carriage 6. Two toothed racks 7 are mounted upon, and fixed rigidly to said carriage 6. The carriage 6 is fitted with rollers 8 so that it may roll along and trasverse a column 9. Gear wheels 10 interconnected by idlers 11 are mounted on said column 9.

The gear wheels 10 are held in engagement with the teeth of the racks 7. Said gear wheels 10 are driven by a reduction gear 12 (FIG. 2) and a ferromagnetic powder brake 13 from an electric motor 14, all of these elements being stationary. An ingot length sensor 15 is coupled by a cable 16 with the exciting winding of said ferromagnetic powder brake 13. Mounted beneath the mold 1 is a load cell 17 adapted to control the ingot withdrawal force. Upon withdrawal the ingot 4 is drawn into an ingot chair 18 installed on a transfer car 19 which conveys it beyond the limits of the casting machine.

The ferromagnetic powder brake 13 is adaptable for creating permanent or variable brake forces, according to the preset loads acting on the rotating shafts of the machines and the gears.

Figure 5:
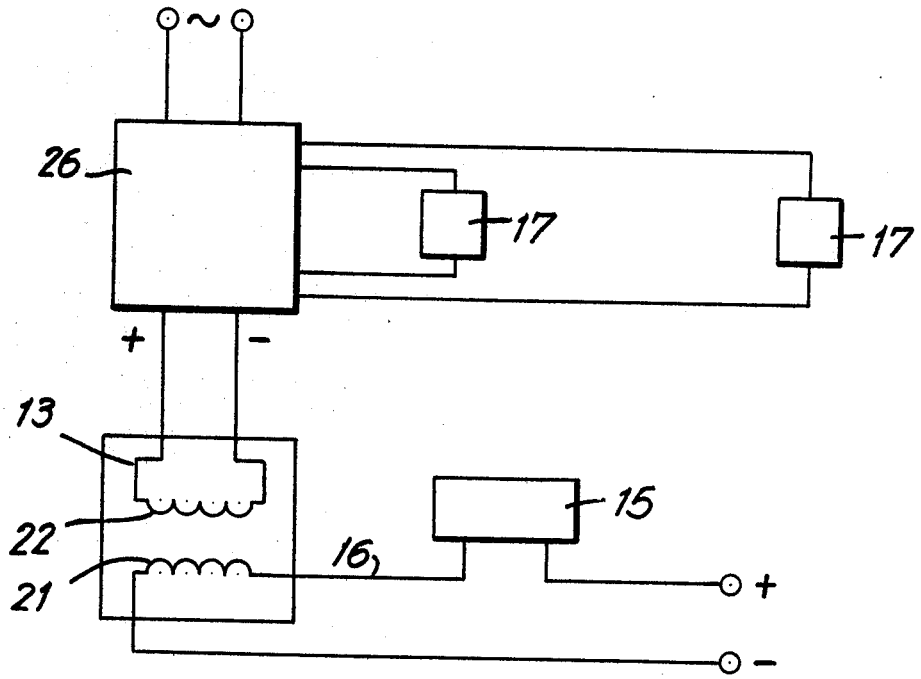
FIG. 5 is an electrical schematic diagram of the brake.

The ferromagnetic powder brake 13 is housed within a bearing casing 20 made of an aluminum alloy (see FIG. 4). An exciting winding 21, a control winding 22 and a rotor 23 set on a shaft 24 are included within the casing 20. One end of the shaft 24 is connected to the electric motor 14 and the other end is connected to the reduction gear 12. In the space within the casing and between the exciting winding 21, the control winding 22 and the rotor 23 ferromagnetic powder is placed. The exciting winding 21 and the control winding 22 are not electrically connected, thus allowing transmission to the brake 13 of independent control signals, which are not associated galvanically with each other. FIG. 5 shows the electrical connections of the device. The exciting winding 21 is connected via the cable 16 to the ingot length sensor and the control winding 22 is connected via an electric current amplifier 26 to the load cell 17.

The brake 13 operates on the same principle as do powder magnetic clutches, i.e. by using the effect of the shear strength brought about in the free ferromagnetic powder when a magnetic field is induced therein. The distinctive feature of said ferromagnetic powder brake consists in that its braking torque is not related to the rotative speed of its shaft.

Said braking torque is controllable from zero to its rated value by accordingly varying the current magnitude in its exciting and control windings.

To enable dissipation of heat released during operation, the brake is fitted with a water cooling system.

As molten metal is being poured into the mold 1, which is swinging on the frame 2 together with the beam apron section 3, the ingot 4 with the dummy bar 5 is drawn by the movable raising-and-descending carriage 6 that is controlled by means of the toothed racks 7. The carriage 6 rolls on wheels 8 along the vertical column 9, thus ensuring the drawing of the ingot 4. The toothed racks 7 are in succession brought into engagement with the gear wheels 10 interconnected by means of the idlers 11. The gear wheels 10 are rotated by the motor 14 by means of the ferromagnetic powder brake 13 and the reduction gear 12. The carriage 6 moves until the ingot 4 is withdrawn from both the mold 1 and beam apron section 3 and is placed into the ingot chair 18.

Following that the ingot 4 is either left to solidify directly on the machine or the transfer car 19 conveys it beyond the limits of the machine proper, whereupon it is left in said chair 18 until it freezes solid, thereby leaving the machine ready for casting the next ingot.

The length of the cast ingot is monitored by the ingot length sensor 15 which sends a pulse through the cable 16 to the exciting winding 21 of the ferromagnetic powder brake 13. The control winding 22 is coupled with the ingot withdrawal force sensor made in the form of a dynamometer 17 installed under the mold 1. The braking torque of the ferromagnetic powder brake 13 is independent of its speed and is readily adjustable by varying the current magnitude in the exciting winding 21 of said brake. As the length and weight of the ingot 4 increase, the braking torque of the brake 13 coupled with the ingot length sensor 15 increases as well. This assures a stable load on and a constant speed of rotation of the motor 14. Variations in the force of withdrawal of the ingot 4 from the mold 1 during its oscillations are adjusted by the dynamometers 17 installed beneath the mold 1, this creating a variable torque on the ferromagnetic powder brake 13. As the mold 1 is descending outstripping the ingot 4, the braking torque applied to the brake 13 increases, whereas during an upward movement of said mold 1, the braking torque and hence the load on the motor 14 diminish.

If the weight of the carriage 6 is G and the force required for withdrawing an ingot 4 from a mold 1 and a beam apron section 3 is P, the motor 14 must develop a torque which can be expressed as $$M = M_0 - (r/i)(G + T \pm P)\eta,$$

where $r$ is the radius of the gear wheels 10 meshed with the racks 7;

$i$ is the gear ratio of the reduction gear 12;

$T$ is the ingot weight that is equal to $T = q \cdot l$ where $l$ is the ingot length and $q$ is the weight of an ingot unit length;

$\eta$ is the drive efficiency; and $M_o$ is the torque of the ferromagnetic powder brake 13.

To ensure a constant load on the drive $$M_0 = (r \cdot \eta/i)\, q \cdot l + (r \cdot \eta/i)(G \pm P),$$

Consequently the torque developed by the ferromagnetic powder brake 13 at $P =$ const can be expressed as $$M_0 = M_1 + K1$$

where $$M_1 = (r \cdot \eta/i)(G \pm P)$$

and the proportionality factor $$K = r \cdot \eta/i\, q$$

It differs for ingots of various cross-section and is readily adjustable. As the mold is swinging, the force P varies alternately from a positive to a negative value and the torque developed by the brake 13 (and the value of $M_1$) must be changed by an increment $$\Delta M = \pm (r \cdot \eta/i)\, P$$

The force P is adjusted by the dynamometers 17.

The pitch $l_1$ of the gear wheels 10 ranges within 0.5–1.0 of the rack length $l_2$ which assures smooth transfer of the carriage 6 with the ingot 4.

As regards the ingot length sensor 15, it is preferably a potentiometer which is linked mechanically with the ingot withdrawal gear drive and whose resistance varies in proportion to an increase in ingot length.

The load cell 17 (the sensor for measuring the force required for withdrawal of an ingot from a mold) constitutes a magnetically - elastic sensor, comprising a steel core with windings arranged in two groups located in horizontal and vertical planes. As a pressure is applied to said sensor, the steel permeability and accordingly the coil impedance will change and a signal received at the sensor output will be proportional to the applied force.

A distinctive design feature of the proposed machine resides in that the weight of said raising-and-descending carriage 6 exceeds the force required for withdrawal of an ingot 4 from a mold 1 and a beam apron section 3, said weight ranging within 1.05–1.50 of the withdrawal force. Otherwise the force taken up by the carriage 6 would be of an alternating nature which would cause jerks in the gear wheels 10 and idlers 11 in mesh with one another, and vibrations due to freeplay.

It is the fact that the weight of said carriage 6 always exceeds the force required for withdrawal of an ingot from a mold 1 and a beam apron section 3, that assures smooth transfer of said ingot without jerks and blows, and enhances the ingot quality and the reliability of operation of the machine of the invention.

The above outlined machines are adaptable for producing round, square, rectangular and octahedral ingots of up to 1000 mm cross-section, the ingot length varying from 8–11 m and their maximum mass in one strand from 50–100 t.

As to possible application of the proposed machine in ferrous metallurgy and machine building, three main fields can be pointed out.

1. Ingots used as consumable electrodes. The refining technique is of primary importance in terms of improving the quality of metal. The proposed machine must provide electrodes up to 1000 mm in diameter and in the coming years — up to 2000 mm, with due account of the current trend towards new advanced remelting (refining) processes. Application of said new processes will enable a 5–10% reduction in metal losses when producing electrodes.

2. Billets use in break-down mills (roughers). At present continuous casting accounts for 10–20% of the total amount of metal. Within the next few years this proportion will increase but for many years to come the major percentage of steel will be obtained by teeming.

Undoubtedly, the break-down mills will retain their importance and will operate for several decades more because their elimination from the flow sheets of the plants where they have been already operating will require great outlays (though on some occasions it is carried into effect). The teeming technique is regarded by the majority of those skilled in the art as obsolete, but the proportion of steel ingots produced by this, obsolete method will continue for many years to come. This technical contradiction can be settled by casting ingots for break-down mills on the proposed machines.

Shrinkage pipes will be encountered not at each 1.5–2.0 m but after each 10–12 m of the ingot length, thereby causing the yield to reach 93–95% and when feeding with electrodes, which is quite feasible on the proposed machine, even 97–98%.

The outlays required for erecting said machines (the mass of each caster approximating 500–600 t ) will pay for themselves by a 8–14% gain in the yield and an improved quality of the ingots.

Thus the prior-art principle of "continuous casting instead of blooming mills" must be complemented by "continuous casting for blooming mills".

This will enable replacement within short time periods of the obsolete teeming technique by a more advanced process - casting into water-cooled molds which will create a new trend in producing heavy ingots in metallurgy.

3. Application of the above machines for semicontinuous casting of metals for producing heavy ingots enables radical changes in the process of manufacturing forging ingots.

At present, a characteristic of forging shops is an extremely low yield (63–64%). With application of the proposed machine metal losses will be expressed by the following figures: 5% for shrinkheads (instead of 20% when teeming into molds due to a 4 fold increase in the ingot length even with the same shrinkheads); 1.25% from ingot bottoms; 5% from burning losses; and 5% for crops which gives a total of 16.25%. Considering possible additional losses of 0.75%, the total losses of metal will reach 17% (with a reserve), the yield for forging shops increasing from 63 to 83%, i.e. by 20%. With an annual machine production rate of 100000 t it will save 20000 t of steel.

The herein-proposed machine enables a radical change in the process of fabrication of forging ingots, the yield being increased by 20% along with an improved quality of said ingots, a decrease in the volume of manual labor for producing and servicing of the molds and a higher production efficiency.

We claim:

1. A machine for semicontinuous casting of metals, comprising: a mold; a frame on which said mold is mounted; a vertical guide column arranged parallel to the withdrawal axis of an ingot near the mold; a carriage mounted movably along said vertical column and carrying a dummy bar on a cantilevered end extending to the mold; means for withdrawing said ingot from the mold and for driving the carriage with said dummy bar, said means comprising a driving electric motor, a reduction gear and a rack-and-gear drive, a toothed rack of said rack-and-gear drive being fixed directly on said carriage, gear wheels of said rack-and-gear drive having teeth in mesh with teeth of said rack, said gear wheels being arranged in succession along said column, said electric motor and said reduction gear being mounted stationary at a sufficient distance from the zone of withdrawal of said ingot from a mold; and braking means to compensate for withdrawal forces increasing as the ingot is being drawn, so that a constant load on the driving electric motor is maintained.

2. A machine according to claim 1, wherein the gear wheels of said rack-and-gear drive are alternated with idlers so that the distance between the centers of adjacent gear wheels varies within 0.5–1.0 of the length of said toothed rack fixed on the carriage.

3. A machine according to claim 1, wherein in its initial top position the weight of the movable carriage amounts to 1.05–1.50 of the mechanical force required for withdrawal of said ingot from said mold.

4. A machine according to claim 1, further comprising an ingot withdrawal force sensor installed between said mold and said frame; a length sensor of said ingot being withdrawn associated with said reduction gear, said sensors being operatively coupled to said braking means to control the brake force as the ingot is being withdrawn from the mold.

5. A machine according to claim 4, wherein said braking means comprise a ferromagnetic powder brake including a double-shaft electric motor having an exciting winding coupled to said ingot length sensor and a control winding coupled with said ingot withdrawal force sensor.

* * * * *